US005395096A

United States Patent [19]

Moreira et al.

[11] Patent Number: 5,395,096

[45] Date of Patent: Mar. 7, 1995

[54] DROP-IN FURNACE LINING

[75] Inventors: Nelson C. Moreira, Elizabeth, N.J.; Raymond J. Sarlitto, Yorktown Heights, N.Y.; Michael J. Fisher, Mohegan Lake, N.Y.; Thomas Bisco, Carmel, N.Y.

[73] Assignee: Praxair Technology, Inc., Danbury, Conn.

[21] Appl. No.: 174,721

[22] Filed: Dec. 29, 1993

[51] Int. Cl.[6] ..... C21C 5/42

[52] U.S. Cl. ..... 266/280; 266/281

[58] Field of Search ..... 266/280, 281

[56] References Cited

U.S. PATENT DOCUMENTS

| | | | |
|---|---|---|---|
| 4,077,616 | 3/1978 | Smejkal | 266/281 |
| 4,534,730 | 8/1985 | Kraus | 266/281 |
| 4,607,994 | 8/1986 | Jacobsson | 266/281 |
| 5,120,027 | 6/1992 | Pelton | 266/200 |
| 5,234,202 | 8/1993 | Pelton | 266/225 |

*Primary Examiner*—Peter D. Rosenberg

*Attorney, Agent, or Firm*—Alvin H. Fritschler

[57] ABSTRACT

A cast refractory and back-up insulation are positioned on a lifting frame for convenient placement in, and removal from, the furnace shell of an aluminum or other metal refining system. Furnace lining replacement is thereby readily accomplished at the operational location of the furnace.

6 Claims, 3 Drawing Sheets

DROP-IN FURNACE LINING

BACKGROUND OF THE INVENTION

1. Field of the Invention

This invention relates to the refining of molten metal. More particularly, it relates to the lining of an aluminum or other molten metal refining vessel.

2. Description of the Invention

In the refining of aluminum, the prior use of externally heated, refractory lined cast iron tubs as refining vessels has been found to be disadvantaged by the limited and somewhat unpredictable life of such tubs. This undesired condition results from the failure of the cast iron tubs because of cracking, bulging, chloride corrosion or wash-out. In addition, design constraints pertaining to such cast iron tubs result in the use of vessel configurations that are difficult to clean, creating a further practical disadvantage to their use in commercial operations.

In an effort to overcome such disadvantages, refining systems were devised consisting of refractory lined vessels having electrical heating elements positioned in graphite blocks. Such systems comprised vessels adapted for the holding of aluminum in a molten state and including a shell having an inner refractory lining impervious to molten metal, with a lining comprising graphite blocks for a portion of the interior of the shell that is intended to be below the surface of the melt, and at least one electrical heating means disposed within one or more of the graphite blocks.

In the construction of a conventional all-refractory molten aluminum furnace or holding vessel, the vessel is usually lined with dense castable refractory or with dense refractory bricks. This material is not infiltrated by molten aluminum because it is too dense and contains only a small amount of porosity in the form of isolated bubbles and the like. The dense lining is backed up with a low density refractory insulating material which, in turn, is contained within a steel shell.

A common practice used to build or reline a conventional aluminum refining furnace involves pouring a castable refractory into the insulation-lined steel shell. The cast refractory must then be dried and cured in-situ by a lengthy process of heating the assembly in an oven or by the use of radiant heaters positioned inside the furnace.

In order to overcome the limitations of such in-situ casting approach, a pre-fired inner refractory lining has been inserted into a steel furnace shell lined with insulation. This approach requires less time than the casting and in-situ dryout procedure. Nevertheless, it still requires that a spent furnace be removed from its operating location, and lifted by a crane or other such device in order to dump the refractory lining material and repair or replace the refractory insulation of the stripped shell before insertion of the replacement preformed refractory lining.

There is a genuine desire and need in the art to develop an improved refractory lining for molten aluminum refining vessels and other such molten metal holding vessels. In particular, there is a need for lining structures that simplify the procedure for furnace lining, so as to preclude the need for removal of a spent furnace from its operational location and minimize the period of time in which the furnace is out of service.

With these and other objects in mind, the invention is hereinafter described in detail, the novel features thereof being particularly pointed out in the appended claims.

SUMMARY OF THE INVENTION

A preformed and pre-fired refractory lining is positioned on a lifting frame for ready installation in a furnace shell as an integral unit and for its convenient replacement at the operational location of the furnace.

BRIEF DESCRIPTION OF THE DRAWINGS

The invention is hereinafter described in detail with reference to the accompanying drawings in which.

DETAILED DESCRIPTION OF THE INVENTION

Figure 1:
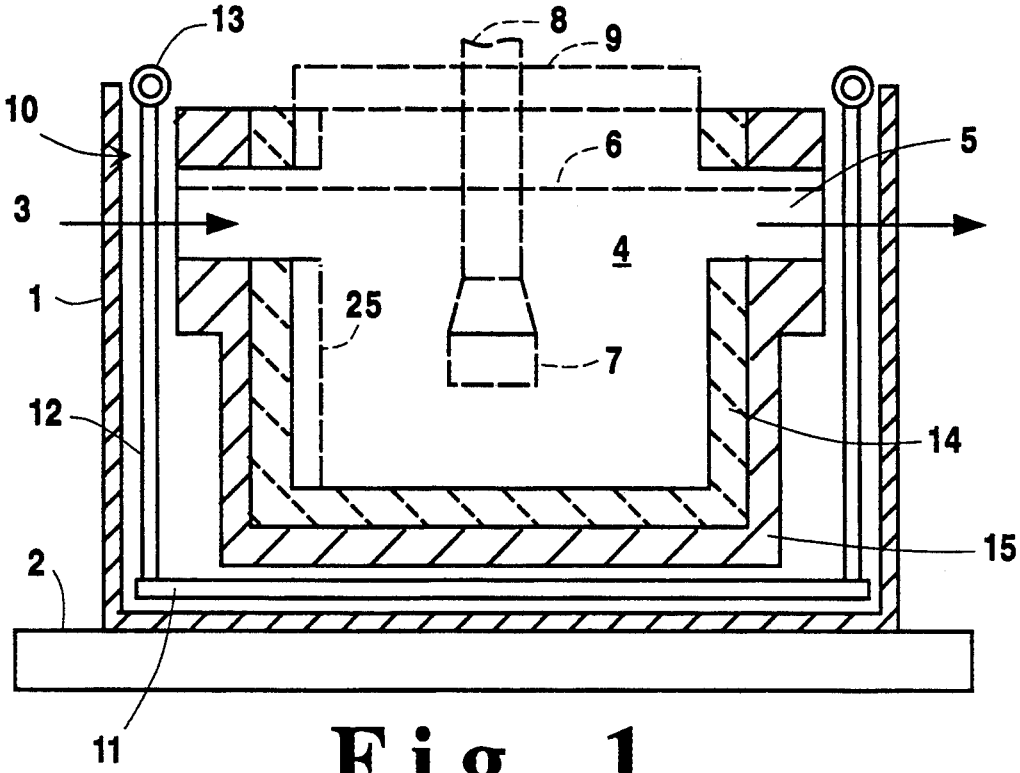
FIG. 1 is a side elevational view of the drop-in furnace lining of the invention positioned in a furnace shell.

The objects of the invention are accomplished by providing a preassembled refractory lining positioned on a lifting frame for ready and convenient installation in the furnace shell of a refining vessel as an integrated unit. This preassembled refractory lining, herein referred to as a drop-in furnace lining, is both pre-formed and pre-fired prior to installation. Such drop-in lining can also be readily and conveniently lifted out of the furnace shell for replacement with a new preassembled refractory lining as appropriate. Thus, the furnace does not have to be removed from its operational location and lifted by a crane or other such equipment to dump spent refractory from the furnace shell as in conventional practice.

The only dismantling required in the use of the drop-in furnace lining of the invention is the removal of the cover of the furnace vessel so as to enable a complete preassembled refractory lining to be lifted out of the furnace shell as an integral unit following a period of use, and to be replaced by a new complete preassembled refractory lining at the operational location of the furnace vessel. The newly installed preassembled refractory lining is then heated to the desired service temperature before being filled with molten metal, e.g. aluminum, as operations are resumed in the metal refining vessel. It will be appreciated that the furnace shell can be kept in its desired position in the processing line, with all connecting equipment attached. Consequently, downtime for furnace relining purposes is significantly reduced as compared with the conventional practice in which the entire furnace is removed from its operational location in the refining processing line.

With reference to the drawings, and in particular to FIGS. 1–4 thereof, the furnace shell of a refining vessel are represented by the numeral 1, said furnace shell 1 being typically a steel shell, the base portion of which is positioned on base platform 2 at an operational location of the furnace for use in aluminum refining operations.

Inlet means 3 are provided at one end of the furnace for the passage of molten aluminum to be treated to refining zone 4, with outlet means 5 being provided for the discharge of refired molten aluminum from the opposite end of the furnace. During refining operations, molten aluminum is present in refining zone 4, e.g. to level 6, and spinning nozzle 7 is provided in said refining zone 4, below said level 6, for the injection of sparging gas into the molten aluminum and the creation of a circulating flow pattern of molten aluminum and sparging bubbles in refining zone 4. Spinning nozzle 7 is connected to drive shaft 8 that extends upward past insulated cover 9 to suitable drive means for the rotation of the spinning nozzle in the body of molten aluminum in refining zone 4.

Figure 3:
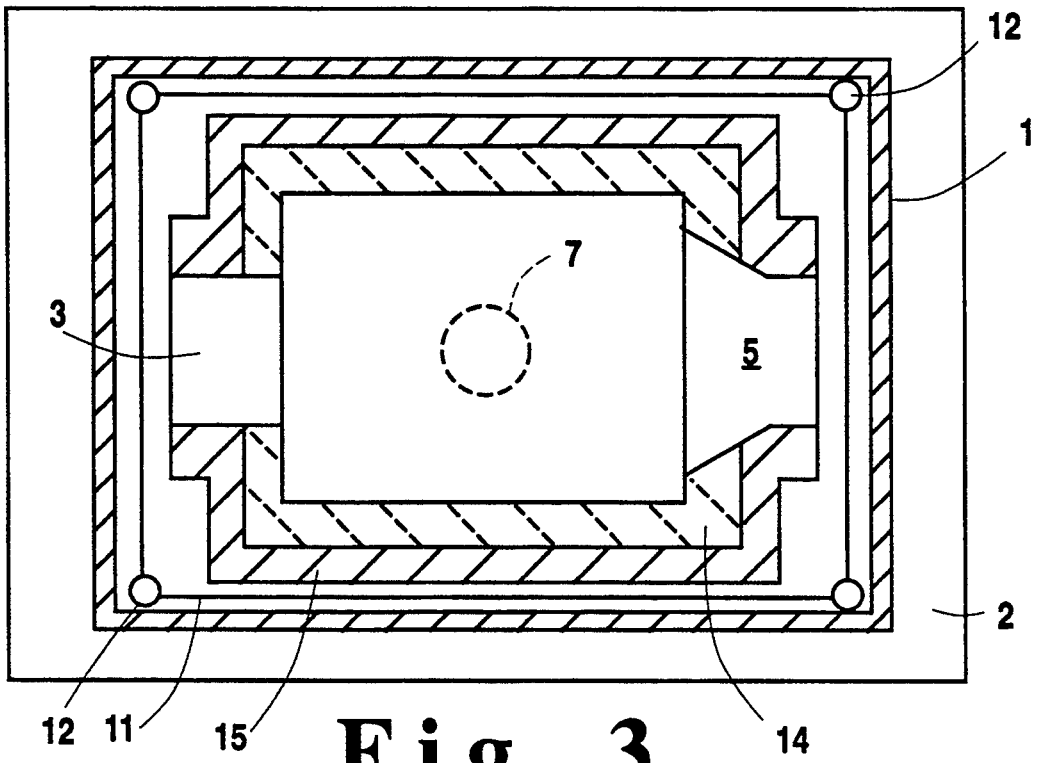
FIG. 3 is a plan view of the drop-in furnace lining of FIGS. 1 and 2.
Figure 4:
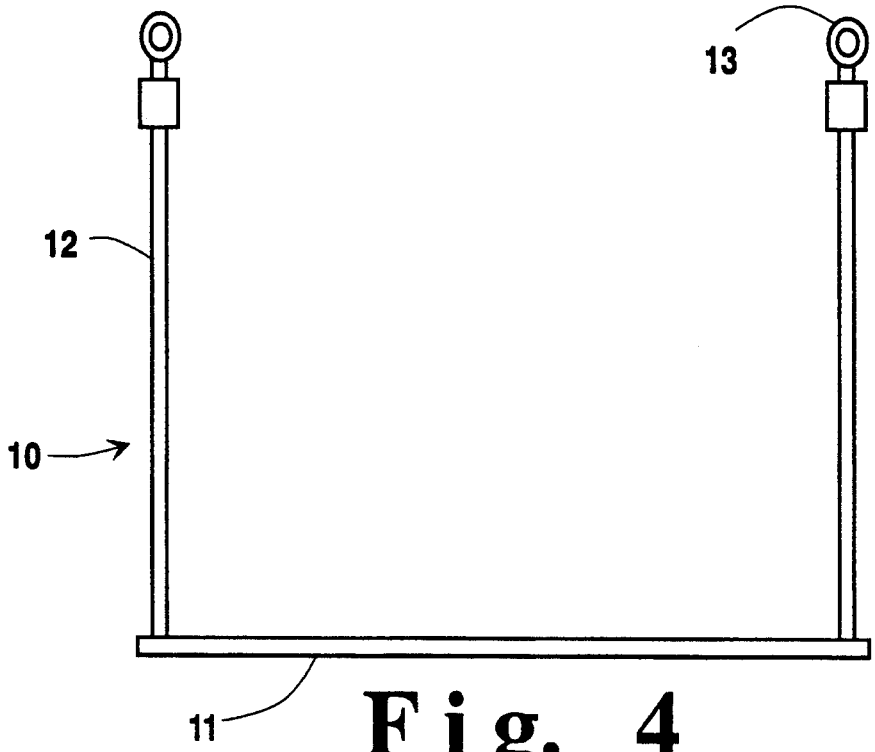
FIG. 4 is a side elevational view of the lifting frame portion of the drop-in furnace lining of the invention.

Within furnace shell 1 in the FIG. 1 illustration, the lifting frame of the invention, shown separately in FIG. 4, is positioned. Said lifting frame, represented generally by the numeral 10, has a steel bottom portion 11 that is shown in said FIG. 1 positioned inside furnace shell 2 and resting on the bottom portion of said furnace shell. Extending upward from bottom portion 11 of the lifting frame are four steel lifting rods or pipes 12, with one such lifting rod 12 being positioned in each corner of the bottom portion 11, as shown particularly in FIG. 3 of the drawings. An eye bolt 13 is affixed to the upper portion of lifting rods 12 to facilitate the movement of lifting frame 10, i.e. for movement into or out of furnace shell 1.

In the construction of the lining portion of the furnace, dense, cast refining lining 14 is provided and is backed up with a low density refractory insulation layer 15. As noted above, dense cast refractory lining 14 is not infiltrated by molten aluminum because it is too dense and contains only a small amount of porosity in the form of isolated bubbles and the like.

The thermal conductivity of suitable dense lining refractories is relatively high compared to that of the material used in insulation layer 15. The thermal conductivity of such hard, dense refractory materials is typically from about 14 to about 20 at 1,500° F. For example, the thermal conductivity of high alumina castable refractory, e.g. a 96% $Al_2O_3$ alumina containing about 0.2 $Fe_2O_3$ with a balance of other materials, commonly used for the hard dense inner lining 14, is about 14 at 1,500° F. and about 19 at 1,000° F. The density of a readily available high alumina castable refractory material, e.g. Alfrax 66, is about 160 lb./ft$^3$, and the density of such dense refractory materials is typically from about 160 to about 180 lb./ft$^3$.

The insulation lining or linings 15 may conveniently comprise a ceramic fibrous refractory insulating material in board or castable form, typically composed of silica and alumina. The weight ratio of such material will vary depending upon the density of various commercial grades of such insulating material. Densities of below 80 lb./ft$^3$, typically from about 15–20 lb./ft$^3$, up to about 55–70 lb./ft$^3$ or more, preferably from about 20 lb./ft$^3$ up to about 60 lb./ft$^3$, are commonly used in aluminum refining furnace applications. The insulation material generally has relatively low thermal conductivity levels of less than abut 1.8, typically about 1 to about 1.6 at 1500° F.

For purposes of the drop-in furnace lining of the invention, the refractory lining is pre-cast and prefired before insertion in furnace shell 1, in contrast to the prior art practices referred to about in which such linings are cast within furnace shell 1, with a firing in-situ for drying and curing, or the alternative approach in which a pre-fired inner refractory lining was inserted into furnace shell 1 lined with insulation.

Figure 2:
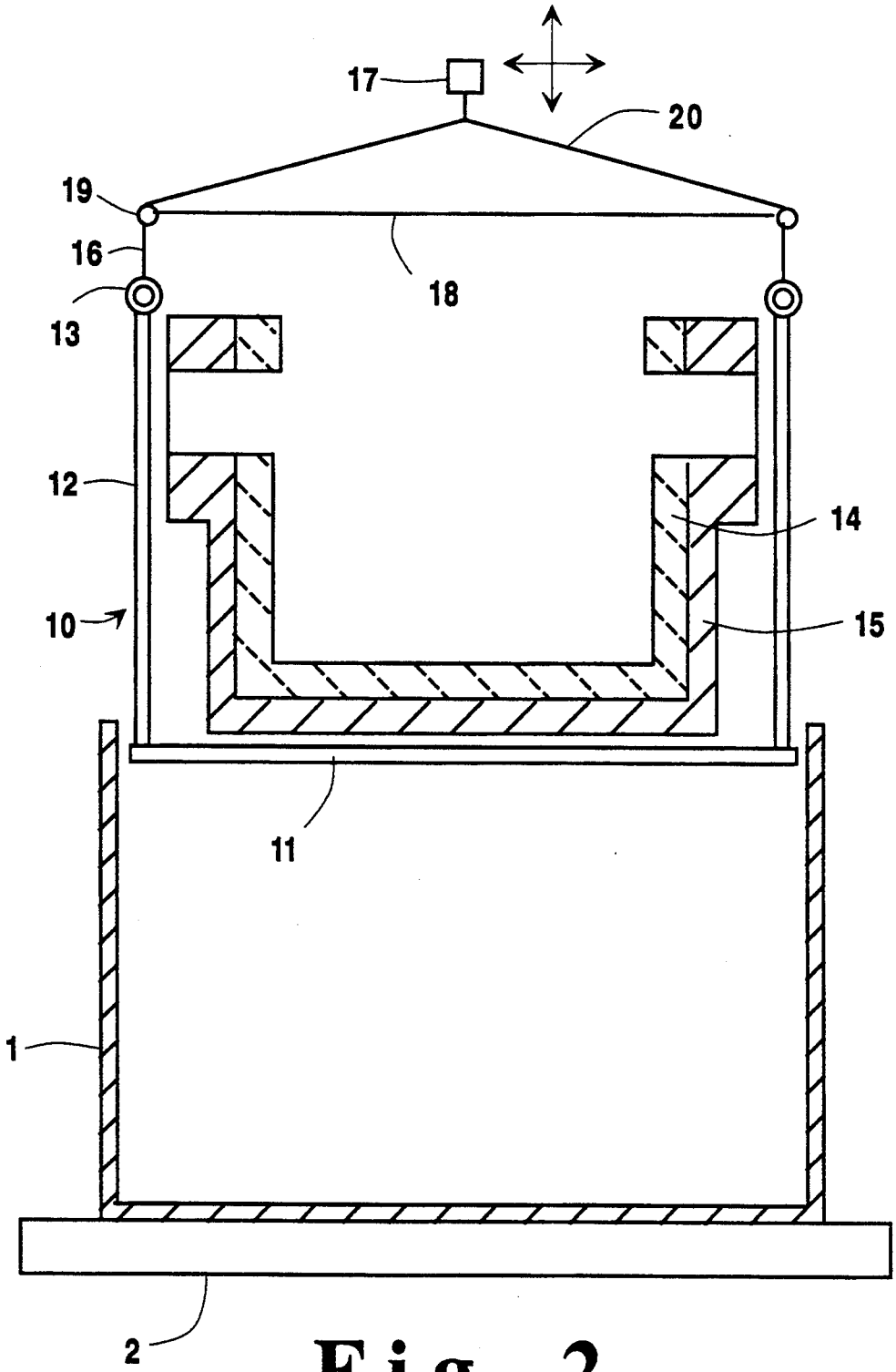
FIG. 2 is a side elevational view of the drop-in furnace lining of the invention in an elevated position, as for installation of said drop-in furnace lining in the furnace shell or its removal therefrom.

Dense cast refractory lining 14 and insulation layer 15 are placed on lifting frame 10 at a convenient location, generally removed from the operational location of the refining vessel, i.e. removed from the site of platform 2 and furnace shell 1. As shown in FIG. 2 of the drawings, cables 16 are attached to eye bolts 13 for the lifting of lifting frame 10, with said inner cast refractory lining 14 and outer insulation lining 15 thereon, for movement by a suitable crane or other moving device, represented generally by the numeral 17, which is capable of raising the lifting frame upward above the height of furnace shell 1 and lowering said lifting frame into place within said furnace shell for use in aluminum refining operations therein. Upon the need to replace a spent lining following a period of use in commercial aluminum refining operations, said cables 16 can be connected to eye bolts 13 of said lifting frame 10, so that said lifting frame can be raised up out of furnace shell 1 at the operational location of the furnace for removal and ready replacement by other drop-in lining conveniently brought to the operational location by said moving device 17. The FIG. 2 illustration shows a drop-in liner being conveniently lowered into furnace shell 1 for use therein or being conveniently lifted therefrom following a period of aluminum refining service.

Figure 5:
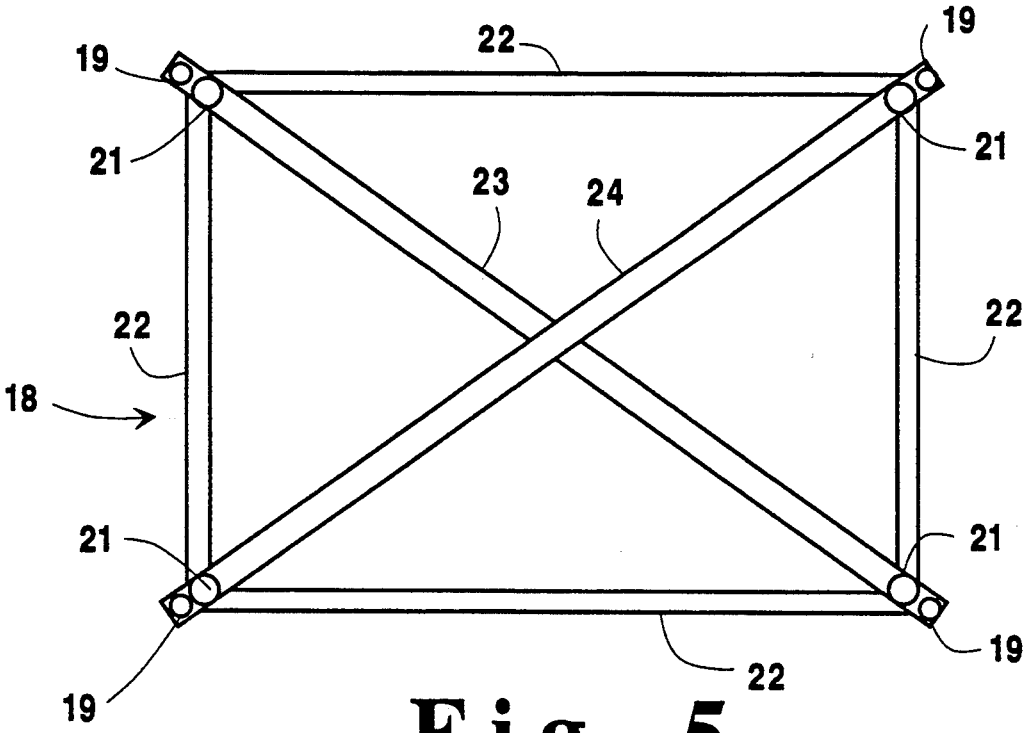
FIG. 5 is a plan view of a lifting bail spreader device adapted to facilitate the lifting of the drop-in furnace lining of the invention.

It will be understood that various changes and modifications can be made in the details of the invention without departing from the scope thereof as set forth in the appended claims. Thus, while four cables 16 connected to eye bolts 13 of said lifting frame 10 can each be connected directly to a center lifting device 17 mechanism, it will be seen that such an arrangement necessarily involves a horizontal force component that may tend to compress the lifting frame and furnace assembly inward, possibly damaging the lining structure positioned therein. Accordingly, it is desirable to employ a lifting bail spreader as illustrated in FIG. 3 and, particularly, in FIG. 5 of the drawings. As shown therein, said lifting bail spreader, represented generally by the numeral 18, has four eye bolts 19 that are adapted for connection with cables 20 extending upward to connect with lifting device 17 used to raise or lower, or move from one location to another, the drop-in liner of the invention, i.e. lifting frame 10 and the inner and outer linings 14 and 15. Said lifting bail spreader 18 also includes eye bolts or other connecting devices 21 so as to enable the ready connection of cables 16 attached to eye bolts 13 of lifting device 10 to said lifting bail spreader 18. By the use of said spreader device, cables 16 will be seen to extend vertically during the raising up, lowering or other movement of lifting device 10, as shown in said FIG. 2. Thus, no horizontal, compressional force is exerted against lifting frame 10 upon its being lifted and removed by lifting device 17. Lifting bail spreader 18 is shown in FIG. 5 as including a rectangular frame comprising four structural members 22 and two cross members 23 and 24 for support purposes. Those skilled in the art will appreciate that eye bolts 13 may be affixed to the upper portion of lifting rods 12 by threading, welding or any other suitable means of attachment, with eye bolts or connecting devices 19 and 21 of lifting bail spreader 18 similarly affixed thereto.

It will also be understood that lifting rods 12 of said lifting frame 10 can extend vertically upward any convenient distance so as to enable said lifting frame to be conveniently raised or lowered for installation in the furnace shell or its removal therefrom and transport away from the operational location of the furnace. It is generally desirable that said lifting rods 12 extend slightly above the upper lend of the furnace shell for such purposes.

In the practice of aluminum refining operations, it is common to employ an additional inner lining of graphite block(s) 25 conveniently kept in place by suitable clips or other means on one or more walls of the furnace. Electric resistance heating elements, not shown, are commonly inserted in an opening in said graphite blocks. It will be appreciated by those skilled in the art that various details or features may be incorporated into the refining vessel configuration, such as the use of more than one refining zone within the furnace shell, with separate spinning nozzles positioned within each refining zone, the use of various baffles to control the flow of molten aluminum into and out of the refining vessel, and the flow path within the vessel itself, and the like.

In prior practice, a precast inner refractory lining, described as a "metal treatment unit", has been described. Such a precast shape does not constitute a complete refractory lining, but only one element of that lining. Moreover, it has been recognized that said precast shape cannot be lifted from the furnace after a period of service by the insertion of eye bolts therein, because the walls of the spent precast shape are not structurally reliable after such service in molten aluminum.

The drop-in furnace lining of the invention enables the entire refractory assembly of inner and outer refractory linings to be lifted from the furnace shell by means of sturdy steel lifting frame 10, whose strength is not compromised by the temperature conditions encountered during molten aluminum refining operations, because, by design, the lifting frame is outside the insulation barrier(s) of the overall assembly. The ability to conveniently place a pre-cast and pre-fired insulation assembly within the furnace shell at the operational location of the refining system, and to conveniently remove the insulation assembly from the furnace shell at the operational location of the furnace represents a highly important advance over the prior art structure and lining replacement practices. The drop-in furnace lining of the invention enables the removal and relining of furnaces to be accomplished with far less maintenance down time. This represents a major advance in the operation and maintenance of aluminum refining systems. In addition, the invention eliminates the common practice of cutting and handling refractory insulation in the refining plant, thereby reducing the highly undesirable exposure of furnace maintenance personnel to refractory material fibers. In addition, the drying and firing of the inner refractory lining as a free standing shape avoids moisture from the cast refractory soaking into the porous insulation and prolonging the pre-heat period for curing of the lining. The drop-in furnace lining of the invention will thus be seen as providing a very significant, practical advance in the art, one that provides several important benefits in the overall field of constructing and maintaining furnace vessels for aluminum or other metal refining operations.

We claim:

1. A drop-in furnace lining for convenient installation in a furnace shell of a metal refining vessel, and for convenient removal therefrom at an operational location of said furnace shell, and movement to and from said operational location, comprising:

(a) a lifting frame adapted to fit within the furnace shell of a metal refining vessel, said lifting frame having (1) a bottom portion that rests upon the bottom portion of the furnace shell upon installation therein, and (2) four lifting rods affixed thereto, one such lifting rod being positioned in each of the corners of the bottom portion of said lifting frame, each of said lifting rods extending vertically upward to an upper portion of the furnace shell, said lifting rods each having cable securing means affixed at upper ends thereof for securing lifting cables thereto to enable the lifting frame to be raised and lowered for movement to and from the operational location of the furnace shell, and for installation in said furnace shell and removal therefrom; and (b) a pre-cast, pre-fired refractory inner lining and a back-up refractory/outer insulation lining for said metal refining vessel, with the pre-cast, pre-fired refractory inner lining and said refractory insulation lining being positioned on the lifting frame, a bottom portion of said refractory outer insulation layer being supported on the bottom portion of said lifting frame, whereby said drop-in furnace lining can be conveniently installed in the furnace shell, and removed therefrom, and moved as an integral unit to and from the furnace shell at the operational location thereof, without movement of said furnace shell from said operational location, by a suitable moving device having cables secured to the cable securing means affixed to the upper ends of the lifting rods of the lifting frame.

2. The drop-in furnace lining of claim 1 in which said metal refining vessel is an aluminum refining vessel, said refractory inner lining and refractory outer insulation lining being adapted for use in said aluminum refining vessel.

3. The drop-in furnace lining of claim 1 in which said lifting rods extend above the upper portion of the furnace shell.

4. The drop-in furnace lining of claim 1 in which said cable securing means affixed to the upper ends of the lifting rods comprise eye bolts.

5. The drop-in furnace lining of claim 1 and including a lifting bail spreader having cable securing means adapted so that cables secured thereto and to the cable securing means of each lifting rod of the lifting frame positioned thereunder will extend vertically upward upon the lifting of the lifting frame by said lifting bail spreader, with said lifting bail spreader being secured by cable means to a moving device for the movement of said drop-in furnace lining to and from the operational location of the furnace shell and for installation of the drop-in furnace in the furnace shell, or its removal therefrom, without horizontal compression forces on said drop-in furnace lining.

6. The drop-in furnace lining of claim 1 in which said lifting frame comprises a steel lifting frame.

* * * * *